US010655403B2

(12) United States Patent
Fraczek et al.

(10) Patent No.: US 10,655,403 B2
(45) Date of Patent: May 19, 2020

(54) SPLITTABLE RISER COMPONENT

(71) Applicant: Ameriforge Group Inc., Houston, TX (US)

(72) Inventors: Justin Fraczek, Houston, TX (US); Waybourn Anderson, Houston, TX (US); Alex Gidman, Houston, TX (US)

(73) Assignee: AMERIFORGE GROUP INC., Houston, TX (US)

( * ) Notice: Subject to any disclaimer, the term of this patent is extended or adjusted under 35 U.S.C. 154(b) by 0 days.

(21) Appl. No.: 15/947,244

(22) Filed: Apr. 6, 2018

(65) Prior Publication Data

US 2018/0320458 A1 Nov. 8, 2018

Related U.S. Application Data

(60) Provisional application No. 62/482,551, filed on Apr. 6, 2017.

(51) Int. Cl.
*E21B 17/08* (2006.01)
*E21B 17/01* (2006.01)

(52) U.S. Cl.
CPC ..... *E21B 17/085* (2013.01); *E21B 17/01* (2013.01)

(58) Field of Classification Search
CPC ..... E21B 17/01; E21B 17/085
USPC ..... 166/367
See application file for complete search history.

(56) References Cited

U.S. PATENT DOCUMENTS

| | | | | |
|---|---|---|---|---|
| 4,183,562 | A | 1/1980 | Watkins et al. | |
| 4,210,208 | A | 7/1980 | Shanks | |
| 4,444,401 | A | 4/1984 | Roche et al. | |
| 4,987,956 | A | 1/1991 | Hansen | |
| 7,237,623 | B2 | 7/2007 | Hannegan | |
| 7,347,455 | B1 * | 3/2008 | Taquino | E21B 17/006 138/89 |
| 8,127,854 | B2 | 3/2012 | Haheim | |
| 8,317,234 | B2 | 11/2012 | McKay | |
| 8,413,724 | B2 | 4/2013 | Carbaugh et al. | |
| 8,528,647 | B2 | 9/2013 | Guesnon et al. | |
| 8,783,359 | B2 | 7/2014 | Reed | |
| 8,863,845 | B2 | 10/2014 | Gilmore et al. | |
| 8,960,302 | B2 | 2/2015 | Shilling et al. | |
| 9,074,425 | B2 | 7/2015 | Feasey | |
| 9,109,420 | B2 | 8/2015 | Tindle et al. | |
| 9,121,227 | B2 | 9/2015 | Thommesen | |

(Continued)

FOREIGN PATENT DOCUMENTS

| | | |
|---|---|---|
| EP | 2992166 | 3/2016 |
| WO | WO 86/02696 | 5/1986 |

(Continued)

OTHER PUBLICATIONS

Frink, "Managed Presser drilling—what's in a name?" Drilling Contractor, Mar./Apr. 2006, 36-39.

(Continued)

*Primary Examiner* — James G Sayre

(74) *Attorney, Agent, or Firm* — Norton Rose Fulbright US LLP

(57) ABSTRACT

This disclosure includes riser-component assemblies and methods of assembling the same that are suitable for managed pressure drilling (MPD) and that can be split apart when using pin connectors to connect auxiliary lines to other auxiliary lines and to components of the riser-component assemblies.

24 Claims, 7 Drawing Sheets

(56) References Cited

U.S. PATENT DOCUMENTS

| | | | | |
|---|---|---|---|---|
| 9,428,975 | B2 | 8/2016 | Stave et al. | |
| 9,765,587 | B2 | 9/2017 | Boulanger et al. | |
| 9,803,443 | B2 | 10/2017 | Tindle et al. | |
| 9,909,379 | B2 | 3/2018 | Fraczek et al. | |
| 9,970,247 | B2 | 5/2018 | Fraczek et al. | |
| 10,012,031 | B2 | 7/2018 | Fraczek et al. | |
| 10,012,044 | B2 | 7/2018 | Leba et al. | |
| 2002/0014340 | A1* | 2/2002 | Johnson | E21B 17/00 166/380 |
| 2008/0264644 | A1* | 10/2008 | Sawtell | E21B 17/085 166/350 |
| 2009/0260831 | A1 | 10/2009 | Moksvold | |
| 2010/0300699 | A1 | 12/2010 | Papon et al. | |
| 2011/0017466 | A1 | 1/2011 | Avelbuch et al. | |
| 2011/0073315 | A1 | 3/2011 | Guesnon et al. | |
| 2011/0209876 | A1 | 9/2011 | Reed et al. | |
| 2011/0225789 | A1 | 9/2011 | Darnell | |
| 2011/0253445 | A1 | 10/2011 | Hannegan et al. | |
| 2012/0037377 | A1 | 2/2012 | Walker | |
| 2012/0055677 | A1 | 3/2012 | Boyd | |
| 2012/0132432 | A1* | 5/2012 | Carbaugh | E21B 17/085 166/345 |
| 2012/0312544 | A1 | 12/2012 | Tavner et al. | |
| 2013/0043036 | A1 | 2/2013 | Kotrla et al. | |
| 2013/0161021 | A1* | 6/2013 | Makosey | E21B 17/01 166/345 |
| 2014/0193282 | A1 | 7/2014 | Stave et al. | |
| 2014/0209316 | A1 | 7/2014 | Tindle et al. | |
| 2014/0262313 | A1 | 9/2014 | Gilmore et al. | |
| 2015/0096759 | A1* | 4/2015 | Gilmore | E21B 43/01 166/345 |
| 2016/0032662 | A1* | 2/2016 | Walker | E21B 17/085 166/367 |
| 2016/0076312 | A1 | 3/2016 | Fraczek et al. | |
| 2016/0138352 | A1 | 5/2016 | Leba et al. | |
| 2017/0067295 | A1 | 3/2017 | Gilmore et al. | |
| 2018/0245416 | A1 | 8/2018 | Fraczek et al. | |

FOREIGN PATENT DOCUMENTS

| | | |
|---|---|---|
| WO | WO 2013/024354 | 2/2013 |
| WO | WO 2014/151724 | 9/2014 |
| WO | WO 2014/179532 | 11/2014 |
| WO | WO 2014/179538 | 11/2014 |

OTHER PUBLICATIONS

International Search Report and Written Opinion issued in International Patent Application No. PCT/US2018/026513, dated Jun. 28, 2018.

International Search Report and Written Opinion issued in International Patent Application No. PCT/US2018/026518, dated Jul. 2, 2018.

Extended European Search Report Issued in Application No. 14791083, dated Jan. 5, 2017.

International Preliminary Report on Patentability Issued in Corresponding PCT Application No. PCT/US2018/026513, dated Oct. 8, 2019.

International Preliminary Report on Patentability Issued in Corresponding PCT Application No. PCT/US2018/026518, dated Oct. 8, 2019.

International Search Report and Written Opinion Issued in PCT. US2014/036309, dated Sep. 4, 2014.

* cited by examiner

SPLITTABLE RISER COMPONENT

CROSS-REFERENCE TO RELATED APPLICATIONS

This application claims priority to U.S. Provisional Application No. 62/482,551, filed Apr. 6, 2017, the entire contents of which application are specifically incorporated by reference herein without disclaimer.

FIELD OF INVENTION

The present invention relates generally to riser assemblies suitable for offshore drilling and more particularly, but not by way of limitation, to splittable components of a riser assembly.

BACKGROUND

Offshore drilling operations have been undertaken for many years. Traditionally, pressure within a drill string and riser pipe have been governed by the density of drilling mud alone. More recently, attempts have been made to control the pressure within a drill string and riser pipe using methods and characteristics in addition to the density of drilling mud. Such attempts may be referred to in the art as managed pressure drilling (MPD). See, e.g., Frink, *Managed pressure drilling—what's in a name*?, Drilling Contractor, March/April 2006, pp. 36-39.

SUMMARY

MPD techniques generally require additional or different riser components relative to risers used in conventional drilling techniques. These new or different components may be larger than those used in conventional techniques. For example, riser segments used for MPD techniques may utilize large components that force auxiliary lines to be routed around those components, which can increase the overall diameter or transverse dimensions of riser segments relative to riser segments used in conventional drilling techniques. However, numerous drilling rigs are already in existence, and it is generally not economical to retrofit those existing drilling rigs to fit larger-diameter riser segments. One solution to this problem is found in related U.S. patent application Ser. No. 14/888,894, which is incorporated by reference in its entirety, where auxiliary lines are routed through passages in the periphery of the riser components. While this solution permits these riser components to be used on already existing or conventional drilling rigs, it can create another problem; namely, restricting access to internal features of the riser components unless the auxiliary lines around the riser components are removed. At least some of the presently described embodiments can address this issue for various riser components by allowing the riser components and their associated auxiliary lines to be split in separate pieces.

Some embodiments of the present riser-component assemblies comprise: a housing having a first housing member defining a first opening and having a first mating face, and a second housing member defining a second opening and having a second mating face, the second housing member configured to be releasably coupled to the first housing member to define a chamber in fluid communication with the first and second openings, the chamber configured to receive an annular seal around a primary axis extending through the first and second openings, the first housing member further having a peripheral portion defining a first passage that is distinct from the chamber and configured to receive a pin connector; and a first pin connector extending through the first passage and coupled to the first housing member; where a first end of the first pin connector extends beyond the first mating face such that the first end of the first pin connector can be inserted into a box connector coupled to the second housing member as the first mating face is moved toward the second mating face. Some embodiments further comprise a plurality of auxiliary lines. In some embodiments, the plurality of auxiliary lines comprise a choke line or a kill line. In some embodiments, the first housing member includes a first flange portion through which the first passage extends. In some embodiments, the second housing member includes a peripheral portion defining a second passage that is distinct from the chamber and configured to receive the first pin connector, and the first pin connector extends through the first passage and the second passage. In some embodiments, the first housing member includes a first flange portion through which the first passage extends. In some embodiments, the second housing member includes a second flange portion through which the second passage extends.

Some embodiments of the present riser-component assemblies further comprise: a first auxiliary line coupled to the first housing member and having a first end coupled to the first pin connector. Some embodiments further comprise: a second auxiliary line configured to be coupled to the second housing member; and a box connector on a first end of the second auxiliary line, the box connector configured to receive the first end of the first pin connector as the second mating face is moved toward the first mating face. Some embodiments further comprise: the annular seal, where the annular seal is configured to receive an annular seal designed to seal around a drill string extending through the first and second openings coaxial with the primary axis.

Some embodiments of the present riser-component assemblies further comprise: a first main tube segment having central lumen in fluid communication with the first opening, a first end coupled to the first housing member on a side opposite the first mating face, and a second end spaced apart from the first housing member; and a second main tube segment having a central lumen in fluid communication with the second opening, a first end coupled to the second housing member on a side opposite the second mating face, and a second end spaced apart from the second housing member. Some embodiments further comprise: a first flange coupled to the second end of the first main tube segment, the first flange comprising an auxiliary hole configured to receive a first auxiliary line. In some embodiments, the first auxiliary line has a first end including a box connector configured to receive a portion of the first pin connector, and a second end configured to be coupled to the first flange. Some embodiments further comprise: a second flange coupled to the second end of the second main tube segment, the second flange comprising an auxiliary hole configured to receive an auxiliary line connector having a flange pin connector extending from the second flange toward the first end of the second main tube segment. In some embodiments, the second auxiliary line further comprises a second box connector on a second end of the second auxiliary line, the second box connector configured to receive a portion of the flange pin connector.

Some embodiments of the present riser-component assemblies further comprise: a bracket configured to secure the first pin connector to the first housing member.

In some embodiments of the present riser-component assemblies, the pin connector comprises a flange having a transverse dimension that is larger than a corresponding transverse dimension of the first passage.

In some embodiments of the present methods of assembling a riser-component, the method comprises: positioning an annular seal between a first housing member and a second housing member, the first housing member defining a first opening and having a first mating face, the second housing member defining a second opening and having a second mating face, the second housing member configured to be releasably coupled to the first housing member to define a chamber in fluid communication with the first and second openings, the chamber configured to receive an annular seal around a primary axis extending through the first and second openings, the first housing member further having a peripheral portion defining a first passage that is distinct from the chamber and configured to receive a pin connector (where: a first pin connector extends through the first passage and is coupled to the first housing member with a first end of the first pin connector extending beyond the mating face of the first housing member; and a first auxiliary line having a first end with a first box connector is coupled to the second housing member); aligning the first opening, annular seal, and second opening with the first mating face of the first housing member facing the second mating face of the second housing member; aligning the first box connector of the first auxiliary line with the first end of the pin connector; and moving the second housing member and first housing member together such that the first end of the first pin connector extends into the first box connector.

Some embodiments of the present methods further comprise: coupling a plurality of auxiliary lines to the second housing member. In some embodiments, the plurality of auxiliary lines comprise a choke line or a kill line. In some embodiments, the second housing member includes a peripheral portion defining a second passage that is distinct from the chamber and configured to receive the first pin connector; and the method further comprises aligning the first pin connector with the second passage and moving the second housing member and first housing member together such that the first end of the first pin connector extends through the second passage. In some embodiments, the first housing member includes a first flange portion through which the first passage extends and the second housing member includes a second flange portion through which the second passage extends. In some embodiments, the first pin connector comprises a flange having a transverse dimension that is larger than a corresponding transverse dimension of the first passage; and the method further comprises extending the first pin connector through the first passage on the side of the first mating face until the flange contacts the first mating face. Some embodiments further comprise: coupling the first pin connector to the first housing member with a bracket.

Some embodiments of the present methods further comprise: coupling a first end of a first main tube segment to the first housing member on a side opposite the first mating face, the first main tube segment having a central lumen in fluid communication with the first opening, and coupling a second end of the first main tube segment to a first flange, where the second end of the first main tube segment is spaced apart from the first end of the first main tube segment; and coupling a first end of a second main tube segment to the second housing member on a side opposite the second mating face, the second main tube segment having central lumen in fluid communication with the second opening, and coupling a second end of the second main tube segment to a second flange, where the second end of the second main tube segment is spaced apart from the first end of the second main tube segment. Some embodiments further comprise: positioning a first end of a second auxiliary line in a first auxiliary hole defined on a peripheral portion of the first flange, the second auxiliary line having a second end with a box connector configured to receive a second end of the first pin connector. Some embodiments further comprise: receiving a first portion of a first flange pin connector in a second auxiliary hole defined on a peripheral portion of the second flange, and receiving a second portion of the first flange pin connector in a second box connector on a second end of the first auxiliary line.

In some embodiments of the presents methods of assembling a riser, the method comprises: positioning a first pin connector in a first passage of a first housing member defining a first opening and having a first mating face, the first housing member configured to be coupled to a second housing member defining a second opening and having a second mating face, the second housing member configured to be releasably coupled to the first housing member to define a chamber in fluid communication with the first and second openings, the chamber configured to receive an annular seal around a primary axis extending through the first and second openings, the first housing member further having a peripheral portion defining the first passage such that the first passage is distinct from the chamber; and coupling the first pin connector to the first housing member such that a first end of the first pin connector extends beyond the first mating face. Some embodiments further comprise: coupling a plurality of auxiliary lines to the second housing member. In some embodiments, the plurality of auxiliary lines comprise a choke line or a kill line. Some embodiments further comprise: coupling a first auxiliary line having a first end with a first box connector to the second housing member. Some embodiments further comprise: aligning the first opening, annular seal, and second opening with the first mating face of the first housing member facing the second mating face of the second housing member; aligning the first box connector of the first auxiliary line with the first end of the pin connector; and moving the second housing member and first housing member together such that the first end of the first pin connector extends into the first box connector.

In some embodiments of the present methods, the second housing member includes a peripheral portion defining a second passage that is distinct from the chamber and configured to receive the first pin connector; and the method further comprises aligning the first pin connector with the second passage and moving the second housing member and first housing member together such that the first end of the first pin connector extends through the second passage. In some embodiments, the first housing member includes a first flange portion through which the first passage extends and the second housing member includes a second flange portion through which the second passage extends.

In some embodiments of the present methods, the first pin connector comprises a flange having a transverse dimension that is larger than a corresponding transverse dimension of the first passage; and the method further comprises extending the first pin connector through the first passage on the side of the first mating face until the flange contacts the first mating face.

Some embodiments of the present methods further comprise: coupling the first pin connector to the first housing member with a bracket.

Some embodiments of the present methods further comprise: positioning an annular seal within the chamber.

Some embodiments of the present methods further comprise: coupling a first end of a first main tube segment to the first housing member on a side opposite the first mating face, the first main tube segment having central lumen in fluid communication with the first opening, and coupling a second end of the first main tube segment to a first flange, where the second end of the first main tube segment is spaced apart from the first end of the first main tube segment; and coupling a first end of a second main tube segment to the second housing member on a side opposite the second mating face, the second main tube segment having central lumen in fluid communication with the second opening, and coupling a second end of the second main tube segment to a second flange, where the second end of the second main tube segment is spaced apart from the first end of the second main tube segment. Some embodiments further comprise: positioning a first end of a second auxiliary line in a first auxiliary hole defined on a peripheral portion of the first flange, the second auxiliary line having a second end with a box connector configured to receive a second end of the first pin connector. Some embodiments further comprise: receiving a first portion of a first flange pin connector in a second auxiliary hole defined on a peripheral portion of the second flange, and receiving a second portion of the first flange pin connector in a second box connector on a second end of the first auxiliary line.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the term "substantially" may be substituted with "within [a percentage] of" what is specified, where the percentage includes 0.1, 1, 5, and 10 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), and "include" (and any form of include, such as "includes" and "including") are open-ended linking verbs. As a result, an apparatus that "comprises," "has," or "includes" one or more elements possesses those one or more elements, but is not limited to possessing only those elements. Likewise, a method that "comprises," "has," or "includes" one or more steps possesses those one or more steps, but is not limited to possessing only those one or more steps.

Any embodiment of any of the apparatuses, systems, and methods can consist of or consist essentially of—rather than comprise/include/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Some details associated with the embodiments are described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale for at the least the embodiments shown.

DESCRIPTION OF ILLUSTRATIVE EMBODIMENTS

Figure 1:
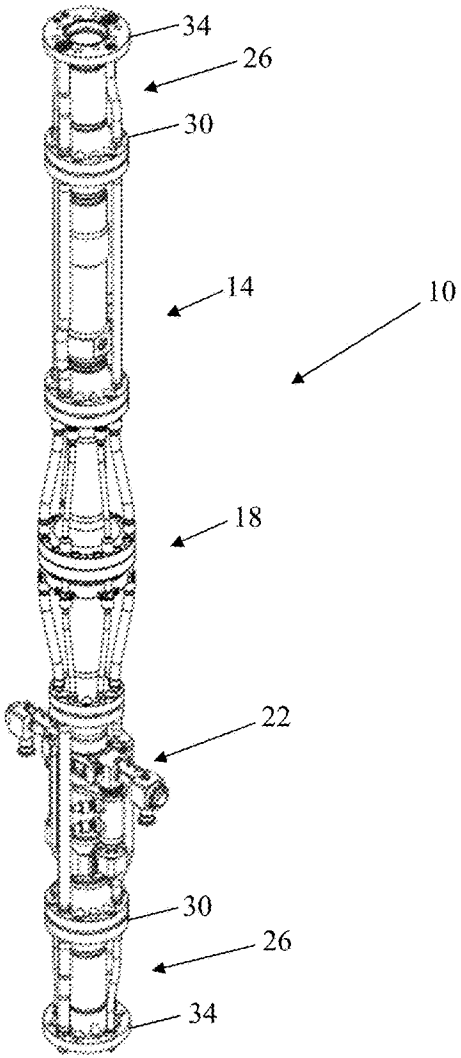
FIG. 1 depicts a perspective view of a riser stack including an embodiment of the present riser-component assemblies.

Referring now to the drawings, and more particularly to FIG. 1, shown there and designated by the reference numeral 10 is one embodiment of a riser assembly or stack that includes multiple riser components. In the embodiment shown, assembly 10 includes a rotating control device (RCD) body component 14, an isolation unit component 18, a flow spool component 22, and two crossover components 26 (one at either end of assembly 10). In this embodiment, crossover components 26 each have a first type of flange 30 at an inner end (facing components 14, 18, 22) and a second type of flange 34 at an outer end (facing away from components 14, 18, 22). Flanges 30 can, for example, include a proprietary flange design and flanges 34 can, for example, include a generic flange design, such that crossover components 26 can act as adapters to couple components 14, 18, 22 to generic riser components with others types of flanges. Crossover components 26 are optional, and may be omitted where riser components above and below components 14, 18, 22 have the same type of flanges as components 14, 18, 22.

Figures 2, 3:
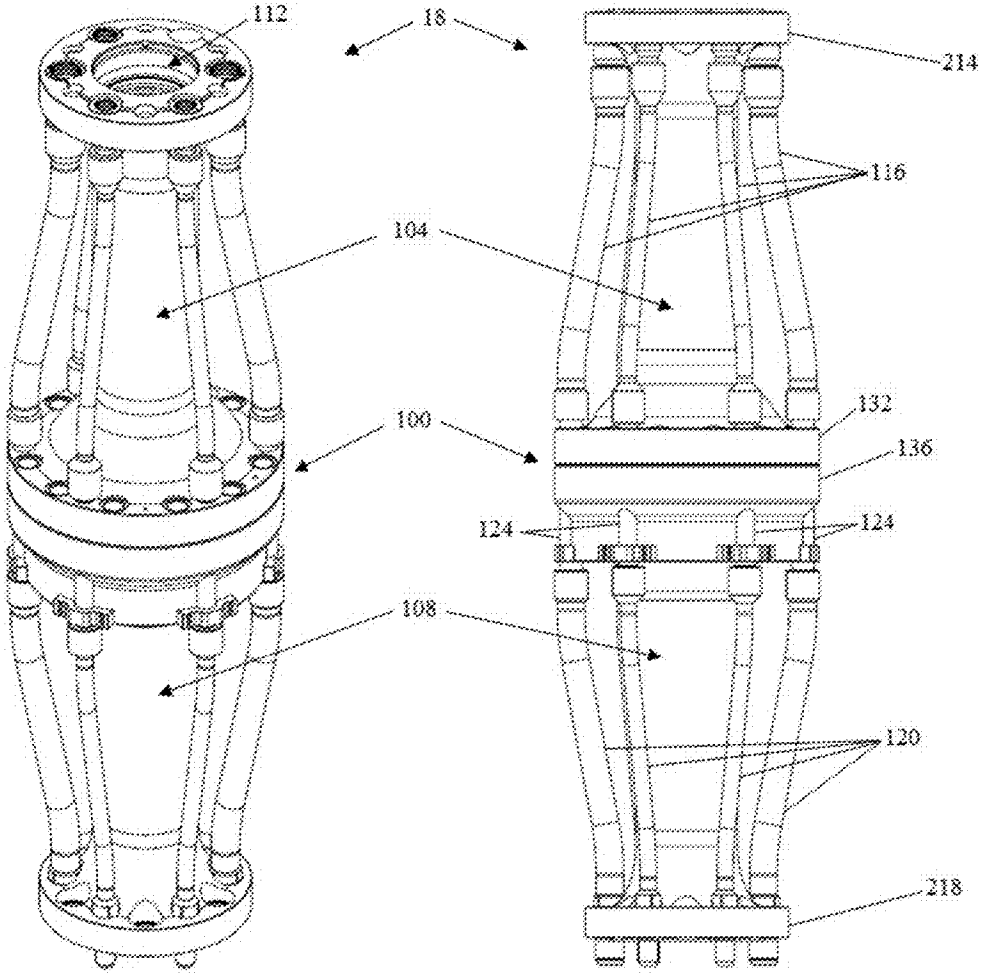
FIGS. 2 and 3 depict a perspective view and side view, respectively, of an embodiment of the present riser-component assemblies that includes an isolation unit.

FIGS. 2-8*c* show the depicted embodiment of isolation unit component assembly 18 in more detail. In this embodiment, assembly 18 includes a housing 100 coupled to upper and lower main tube segments 104, 108. Main tube segments 104, 108 can have central openings or lumens 112 that are in fluid communication with openings 144, 148 of housing 100 (as shown in FIG. 4) and/or adjacent riser components. Upper main tube segment 104 can be coupled to upper flange 214 by conventional means (e.g., welding) to facilitate attachment of isolation unit component assembly 18 to an adjacent riser component. Lower main tube segment 108 can similarly be coupled to lower flange 218 for the same purpose and in the same manner. Isolation unit component assembly 18 can further include one or more upper auxiliary lines 116, each having an upper end 116*a* and a lower end 116*b*; one or more lower auxiliary lines 120, each having an upper end 120*a* and a lower end 120*b*; and one or more pin connectors 124. Upper and lower auxiliary lines can vary in diameter, as shown in FIGS. 2 and 3, and can include any type of auxiliary line, including a choke line or kill line.

Housing 100 can comprise an upper housing member 132 and a lower housing member 136 joined at least in part by pin connectors 124. As shown in FIG. 4, pin connectors 124 can connect to lower end 116*b* of auxiliary lines 116 and/or upper end 120*a* of lower auxiliary lines 120 via box connectors 170 or by other means (e.g., threading). Pin connectors 124 can be coupled to housing 100 by extending through openings or passages 164, 160 in flange portions of upper housing member 132 and lower housing member 136, respectively. Additionally, pin connectors 124 can be secured to lower housing member 136 via brackets 222 (see FIGS. 4B and 5A). As shown in split configuration 1000 (see FIGS. 8A and 8B), pin connectors 124 permit isolation unit component assembly 18 to be split substantially in half in a quick and efficient manner (e.g., by removing pin connectors 124 from box connectors 170 on lower ends 116*b* of upper auxiliary lines 116).

Figure 4C:
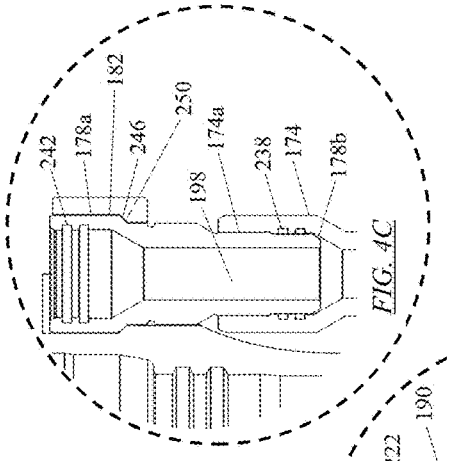
FIGS. 4B-4D depict enlarged cross-sectional views of certain details of the riser-component assembly of FIG. 2, as indicated by regions 4B, 4C, and 4D in FIG. 4A.
Figure 4D:
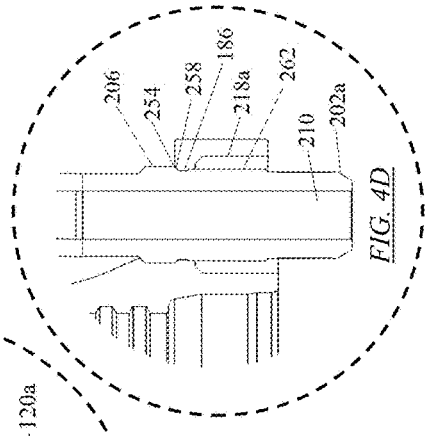
Figure 4B:
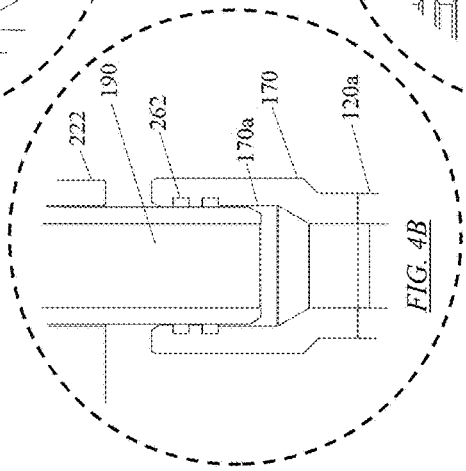
Figure 4A:
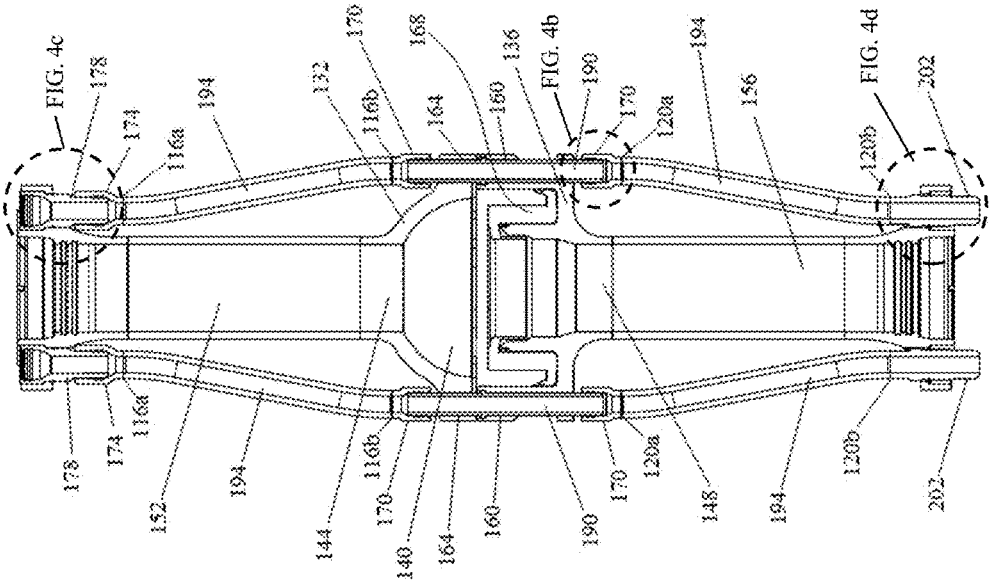
FIG. 4A depicts a cross-sectional view of the riser-component assembly of FIG. 2, with several auxiliary lines omitted for clarity.

As shown in FIG. 4A, housing 100 includes a central chamber 140 that is in fluid communication with opening 144 of upper housing member 132 and opening 148 of lower housing member 136. This configuration allows various fluids, including drilling, production, and completion fluids, or another tubing string, to pass through isolation unit component assembly 18. As shown in FIGS. 5A-6B, an annular seal 128 can have a radially open center portion 128A and be positioned within central chamber 140 around a primary vertical axis of openings 144 and 148 of housing 100. Center portion 128A of annular seal 128 can be large enough to permit a tubing string such as a drill string to pass through annular seal 128 when the tubing string is coaxial with openings 144 and 148 of housing 100. Annular seal 128 can have an open position that permits fluid to freely flow through the annulus around the tubing string; and a closed position that prevents fluid from freely flowing through the annulus around the tubing string. Annular seal 128 can be actuated between the open and closed positions in any manner conventionally known in the art (e.g., via standard hydraulic controls). As is common for annular seals (e.g., BOPs) of this type, housing 100 can additionally include a piston 168 for aiding the actuation of annular seal 128.

As further shown in FIG. 4A, upper and lower auxiliary lines 116, 120 have internal bores 194 that can be in fluid communication with the internal bore 190 of pin connectors 124 when connected to pin connectors 124 via box connectors 170 (or otherwise) such that pin connectors 124 act as a fluid chamber extension of the auxiliary lines 116, 120. As shown more clearly in FIG. 4B, box connectors 170 include a recess 170*a* sized to receive an end portion of pin connectors 124. In the present configuration, box connectors 170 can further include grooves 262 sized to receive sealing and/or lubricating components (e.g., O-rings, rigid washers, grease) to facilitate insertion of an end of pin connector 124 into recess 170*a* of box connector 170. Alternatively or additionally, box connectors 170 can include threading on the interior surface of recess 170*a* that can mate with corresponding threading on the exterior surface of an end of pin connector 124. In the present configuration, box connectors 170 can be connected to lower end 116*b* of upper auxiliary lines 116 or upper end 120*a* of lower auxiliary lines 120 (e.g., via welding) before being connected to pin connectors 124.

In the embodiment shown, each upper auxiliary line 116 includes a second box connector 174 that can be sized to accept pin end 178*b* of upper flange pin connector 178. Box connector 174 can be sized to be the same as or different than box connector 170, depending on the configuration, and can include similar features, including a recess 174*a* and grooves 238, as shown in FIG. 4C. Upper flange pin connector 178 includes a box end 178*a*, a pin end 178*b*, a shoulder 246, and grooves 242. Box end 178*a* can have a larger transverse diameter than pin end 178*b*. As also shown in FIG. 4C, upper flange 214 includes a shoulder 250 and an auxiliary hole 182 that can be sized to receive upper flange pin connector 178. In this configuration, upper flange pin connector 178 can be inserted into hole 182 until its shoulder 246 rests against corresponding shoulder 250 of auxiliary hole 182. Pin end 178*b* of upper flange pin connector 178 can be inserted into recess 174*a* of box connector 174. When so connected, internal bore 198 of upper flange pin connector 178 can be in fluid communication with internal bore 194 of upper auxiliary line 116 such that upper flange pin connector 178 acts as a fluid chamber extension of upper auxiliary line 116. In the present configuration, box connector 174 includes grooves 238 to receive sealing and/or lubricating components (e.g., O-rings, rigid washers, grease) to facilitate insertion of pin end 178*b* of upper flange pin connector 178 into recess 174*a* of box connector 174. Alternatively or additionally, box connector 174 can include threading on the interior surface of recess 174*a* that can mate with corresponding threading on pin end 178*b* of upper flange pin connector 178. Grooves 242 of upper flange pin connector 178 can similarly receive sealing and/or lubricating components (e.g., O-rings, rigid washers, grease) to facilitate insertion of a pin end of another component into box end 178*a* of upper flange pin connector 178 and/or threading on the interior surface of box end 178*a* of upper flange pin connector 178 that can mate with corresponding threading on a pin end of another component.

In the configuration shown in FIG. 4A, the bottom portion of lower auxiliary lines 120 can be connected to lower flange pin connectors 202 (e.g., via welding). As shown in FIG. 4D, lower flange pin connectors 202 include a pin end 202*a* and a flange portion 206 having a lower shoulder 254. Lower flange pin connectors 202 also include external threading 262 and internal bore 210. Lower flange 218 includes a shoulder 258 and an auxiliary hole 186 that can be sized to receive lower flange pin connector 202. Lower flange 218 further includes a recess 218A sized to receive another riser component such as box connector. In the present configuration, lower flange pin connector 202 is coupled to the lower end of auxiliary line 120 (e.g., via welding) such that internal bore 210 is in fluid communication with internal bore 194 of lower auxiliary line 120; and is inserted into auxiliary hole 186 of lower flange 218 until shoulder 254 of lower flange pin connector 202 rests against corresponding shoulder 258 of lower flange 218. Another riser component such as an auxiliary line can be connected to pin end 202*a* of flange pin connector 202 via threads 262 (e.g., by using a box connector received in recess 218A). Alternatively, pin end 202*a* of lower flange pin connector 202 can be connected to a corresponding box end of another riser component such as box end 178*a* of a flange pin connector like upper flange pin connector 178. As another alternative or additionally, threads 262 can be replaced by grooves (or the grooves can be on the interior surface of recess 218A) configured to receive sealing and/or lubricating components (e.g., O-rings, rigid washers, grease) to facilitate insertion of pin end 202*a* of lower flange pin connector 202 into a recess of a corresponding riser component.

Figure 5B:
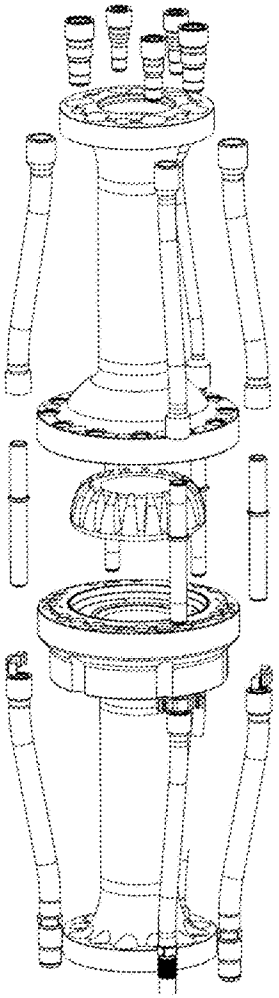
FIG. 5B depicts an exploded side perspective view of the riser-component assembly of FIG. 2.
Figure 5A:
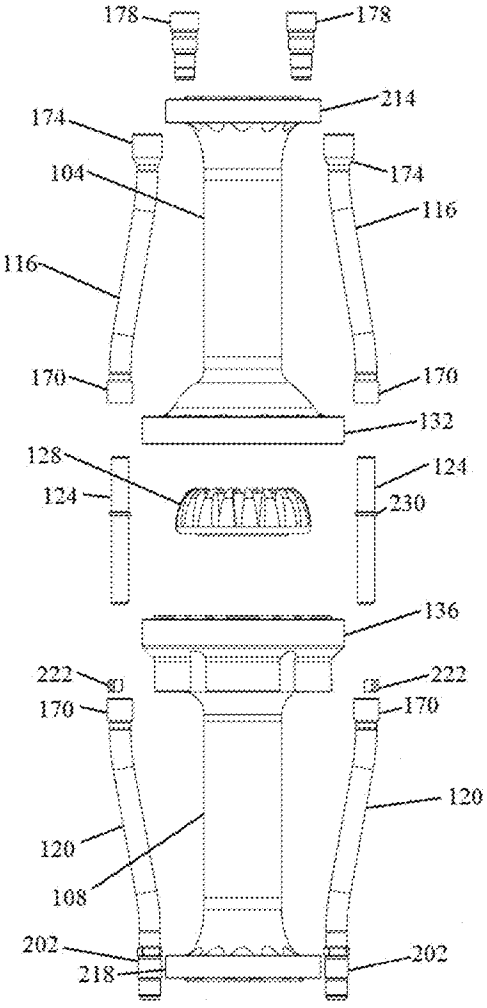
FIG. 5A depicts an exploded side view of the riser-component assembly of FIG. 2, with several auxiliary lines omitted for clarity.

FIG. 5A shows components of the present embodiment as they might appear prior to assembly. Components that are generally permanently connected (e.g., by welding) are shown in FIG. 5A as being connected. In particular, box connectors 170 are shown connected to upper ends 120*a* of lower auxiliary lines 120 and lower ends 116*b* of upper auxiliary lines 116; upper housing portion 132 and upper flange 214 are shown connected to upper main tube section 104; lower housing portion 136 and lower flange 218 are shown connected to lower main tube section 108; box connectors 174 are shown connected to upper ends 116*a* of upper auxiliary lines 116; and lower flange pin connectors 202 are shown connected to lower ends 120*b* of lower auxiliary lines 120. In the present configuration, isolation unit component assembly 18 may be assembled into three primary components: upper isolation unit component assembly 1004, lower isolation unit component assembly 1008, and annular seal 128.

Figure 6B:
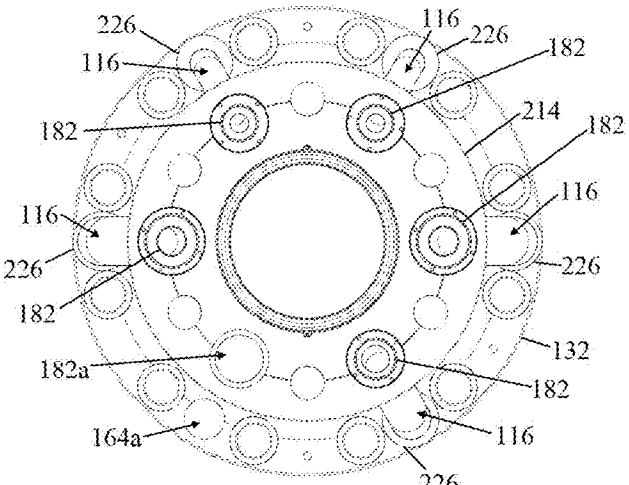
FIGS. 6B and 6C depict a top and bottom view, respectively, of the segment of the riser-component assembly shown in FIG. 6A.
Figure 6C:
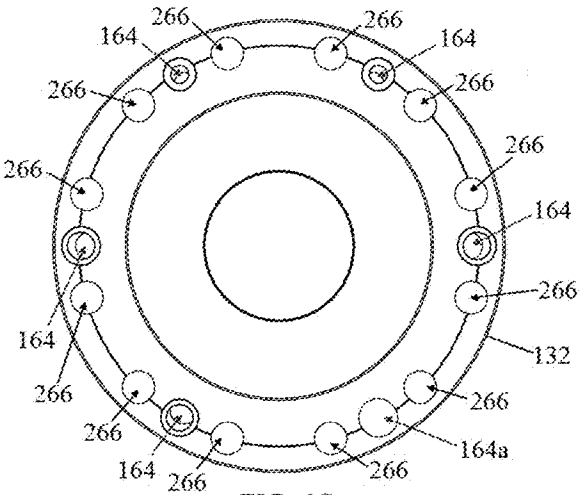
Figure 6A:
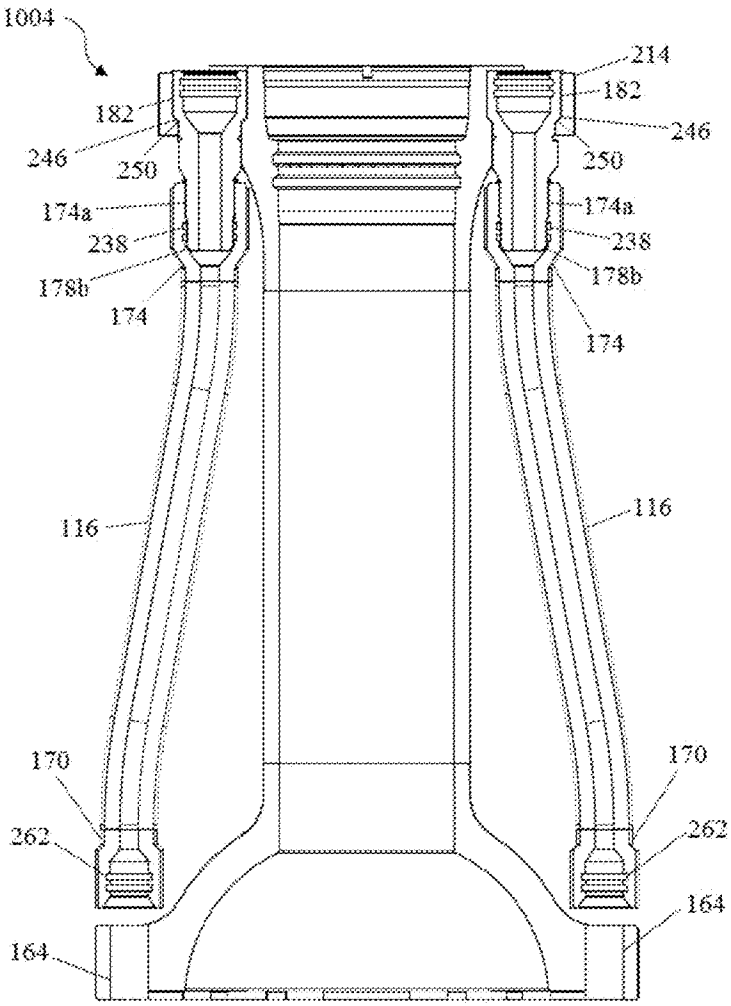
FIG. 6A depicts a cross-sectional side view of a segment of the riser-component assembly of FIG. 2, according to the method of assembly shown in FIG. 8A, with several auxiliary lines omitted for clarity.

As shown in FIG. 6A, upper isolation unit component assembly 1004 can be assembled by inserting pin end 178*b* of upper flange pin connectors 178 through auxiliary holes 182 of upper flange 214 until shoulder 246 of upper flange pin connectors 178 rests against shoulders 250 of upper flange 214. Box connectors 174 (coupled to upper auxiliary lines 116) may then be inserted over pin end 178*b* of upper flange pin connector 178 such that pin end 178*b* enters recesses 174*a* of box connectors 174. Upper flange pin connectors 178 and box connectors 174 may be held together by friction (e.g., facilitated by O-rings, rigid washers, etc. in grooves 238) and/or by threading, depending on the configuration. As shown in FIG. 6B, box connectors 170 can have a maximum transverse diameter 226 such that box connectors 170 do not extend beyond the maximum transverse diameter of upper housing portion 132. While FIG. 6B depicts six auxiliary holes 182 for accepting upper flange pin connectors, upper isolation unit component assembly 18 can be designed to accept any number of upper flange pin connectors depending on the number of auxiliary lines desired. In addition, as shown by auxiliary hole 182*a* and passage 164*a*, not all auxiliary holes 182 or passages 164 are required to accept an upper flange pin connector or align with an upper auxiliary line 116.

Figure 7B:
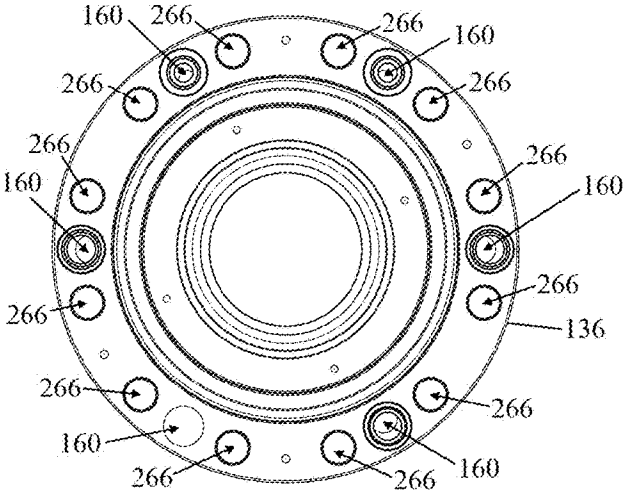
FIGS. 7B and 7C depict a top and bottom view, respectively, of the segment of the riser-component assembly shown in FIG. 7A.
Figure 7C:
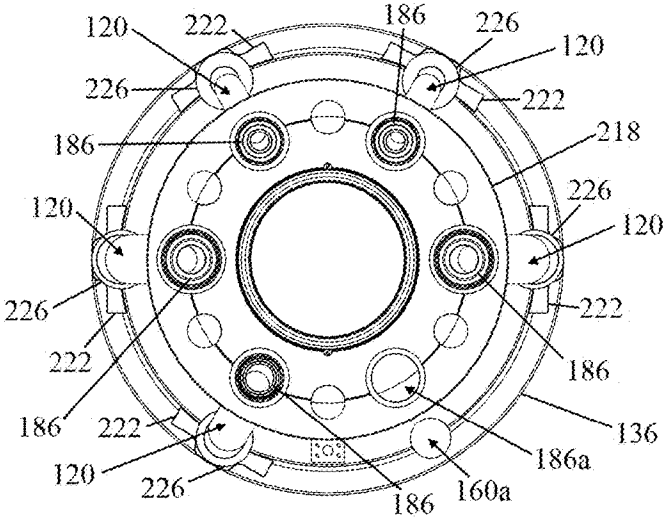
Figure 7A:
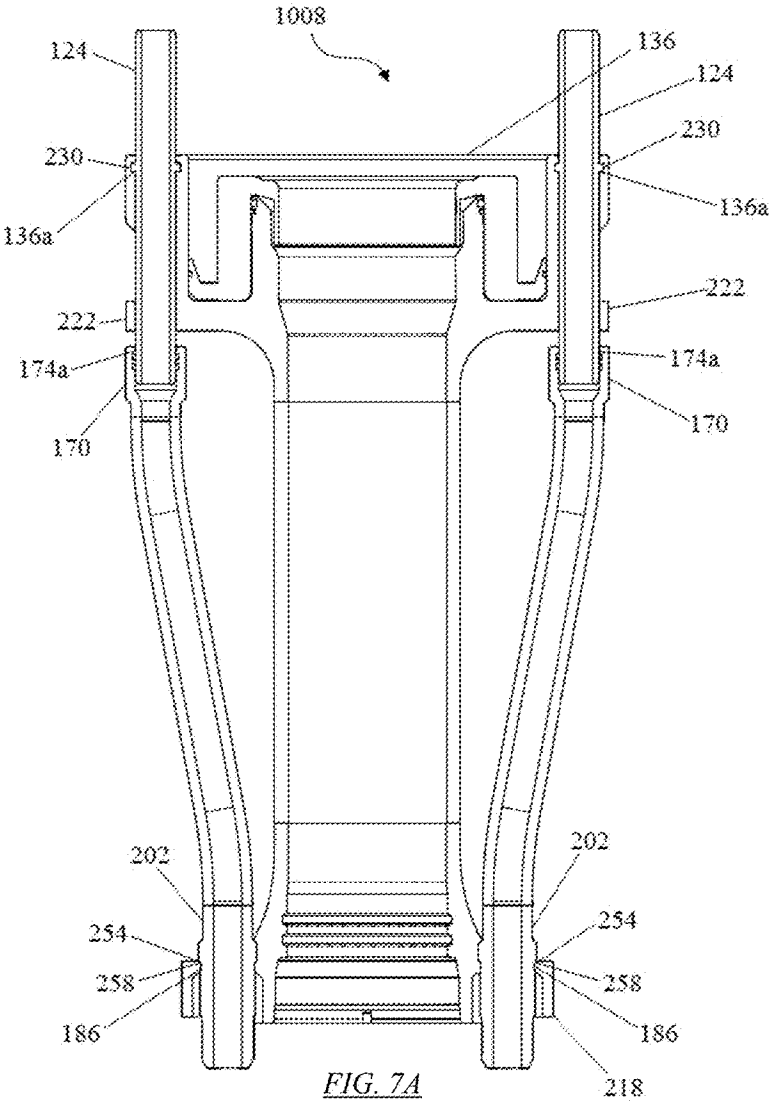
FIG. 7A depicts a cross-sectional side view of another segment of the riser-component assembly of FIG. 2, according to the method of assembly shown in FIG. 8A, with several auxiliary lines omitted for clarity.

As shown in FIG. 7A, lower isolation unit component assembly 1008 can be assembled by inserting lower flange pin connectors 202 into auxiliary holes 186 of lower flange 218 until shoulder 254 of lower flange pin connector 202 rests against shoulder 258 of lower flange 218. Pin connectors 124 can then be inserted through passages 160 (shown more clearly in FIG. 7B) of lower housing member 136 and inserted into recesses 170*a* of box connectors 170. Pin connectors 124 can continue to enter recesses 170*a* until flange 230 of pin connectors 124 rests against shoulder 136A of lower housing member 136. In the present configuration, pin connectors 124 will extend beyond the mating face of lower housing member 136 (i.e., beyond the surface of lower housing member 136 that is capable of mating with upper housing member 132). Brackets 222 can be then placed over pin connectors 124 and fastened to lower housing member 136 to more securely hold pin connectors 124 in place. Brackets 222 can be fastened to lower housing member 136 in any conventional manner including by using screws, bolts, or adhesive. As shown in FIG. 7C, box connectors 170 can have a maximum transverse diameter 226 such that box connectors 170 do not extend beyond the maximum transverse diameter of lower housing portion 136. While FIG. 7C depicts six auxiliary holes 186 for accepting lower flange pin connectors, lower isolation unit component assembly 18 can be designed to receive any number of lower flange pin connectors depending on the number of auxiliary lines desired. In addition, as shown by auxiliary hole 186A and passage 160*a*, not all auxiliary holes 186 or passages 160 are required to accept an upper flange pin connector or a pin connector.

Figures 8A, 8B:
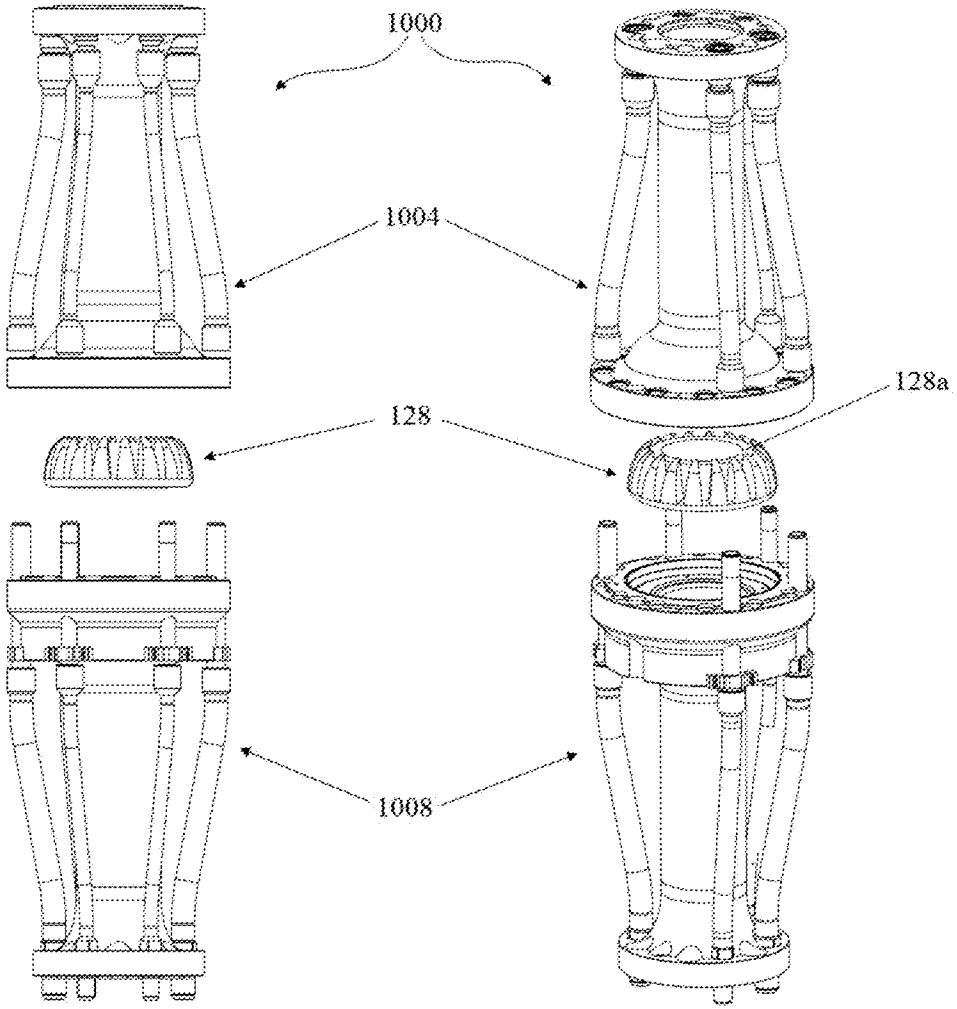
FIGS. 8A and 8B depict a semi-exploded side and perspective view, respectively, of the riser-component assembly of FIG. 2, according to one embodiment of a method of assembly.

Once configured in the manner described, isolation unit component assembly 18 will resemble split configuration 1000 shown in FIGS. 8A and 8B. Isolation unit component assembly 18 can then be formed by positioning annular seal 128 between upper and lower isolation unit component assemblies 1004, 1008 such that the primary central axis of opening 128A aligns with the primary central axis of openings 144, 148 of upper and lower housing members 132, 136, respectively; aligning the upper ends of pin connectors 124 with box connectors 170 on lower ends 116*b* of auxiliary lines 116; and moving upper and lower isolation unit component assemblies 1004, 1008 together until annular seal 128 is received in chamber 140, the upper ends of pin connectors 124 are received within recesses 170*a* of the box connectors 170 connected to the lower ends 116*b* of auxiliary lines 116, and upper housing member 132 rests on lower housing member 136. Upper housing member 132 and lower housing member 136 can be further secured by connecting fasteners (e.g., screws, bolts) through holes 266 of upper and lower housing members 132, as shown in FIGS. 6C and 7B. If access to chamber 140 is desired to remove or replace annular seal 128 or for any other reason, the previous steps may be performed in reverse order to return isolation unit component assembly 18 to split configuration 1000.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted.

Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

While the above specification refers to the embodiment of isolation unit component assembly 18, the invention is not to be so limited. Pin connectors 124 or variations thereof may be used to allow splitting of other types of isolation unit component assemblies or other riser-components including rotating control device (RCD) body components (e.g., RCD body component 14) and flow spool components (e.g., flow spool component 22).

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A riser-component assembly comprising:

a housing having a first housing member defining a first opening and having a first mating face, and a second housing member defining a second opening and having a second mating face, the second housing member configured to be releasably coupled to the first housing member to define a chamber in fluid communication with the first and second openings, the chamber configured to receive an annular seal around a primary axis extending through the first and second openings, the first housing member further having a peripheral portion defining a first passage that is distinct from the chamber and configured to receive a pin connector; and a first pin connector extending through the first passage and coupled to the first housing member, where the first passage is configured to surround a majority of a circumference of the first pin connector when the first pin connector extends through the first passage to restrict lateral movement of the first pin connector relative to the housing in a direction away from the primary axis;

where a first end of the first pin connector extends beyond the first mating face such that the first end of the first pin connector can be inserted into a box connector coupled to the second housing member as the first mating face is moved toward the second mating face.

2. The assembly of claim 1, further comprising a plurality of auxiliary lines.

3. The assembly of claim 1, where the first housing member includes a first flange portion through which the first passage extends.

4. The assembly of claim 1, where the second housing member includes a peripheral portion defining a second passage that is distinct from the chamber and configured to receive the first pin connector, and the first pin connector extends through the first passage and the second passage.

5. The assembly of claim 4, where the first housing member includes a first flange portion through which the first passage extends.

6. The assembly of claim 5, where the second housing member includes a second flange portion through which the second passage extends.

7. The assembly of claim 4, where the second passage is configured to surround a majority of the circumference of the first pin connector when the first pin connector is received through the second passage.

8. The assembly of claim 7, where the second passage is configured to entirely surround the circumference of the first pin connector when the first pin connector is received through the second passage.

9. The assembly of claim 4, where the second passage is configured to restrict lateral movement of the first pin connector relative to the housing in a direction away from the primary axis.

10. The assembly of claim 1, further comprising:

a first auxiliary line coupled to the first housing member and having a first end coupled to the first pin connector.

11. The assembly of claim 10, further comprising:

a second auxiliary line configured to be coupled to the second housing member; and a box connector on a first end of the second auxiliary line, the box connector configured to receive the first end of the first pin connector as the second mating face is moved toward the first mating face.

12. The assembly of claim 1, further comprising the annular seal disposed in the chamber, where the annular seal is configured to seal around a drill string extending through the first and second openings coaxial with the primary axis.

13. The assembly of claim 1, further comprising:

a first main tube segment having central lumen in fluid communication with the first opening, a first end coupled to the first housing member on a side opposite the first mating face, and a second end spaced apart from the first housing member; and a second main tube segment having a central lumen in fluid communication with the second opening, a first end coupled to the second housing member on a side opposite the second mating face, and a second end spaced apart from the second housing member.

14. The assembly of claim 1, further comprising a bracket configured to secure the first pin connector to the first housing member.

15. The assembly of claim 1, where the pin connector comprises a flange having a transverse dimension that is larger than a corresponding transverse dimension of the first passage.

16. The assembly of claim 1, where the first passage is configured to entirely surround the circumference of the first pin connector when the first pin connector is received through the first passage.

17. A method of assembling a riser-component comprising:

positioning an annular seal between a first housing member and a second housing member, the first housing member defining a first opening and having a first mating face, the second housing member defining a second opening and having a second mating face, the second housing member configured to be releasably coupled to the first housing member to define a chamber in fluid communication with the first and second openings, the chamber configured to receive an annular seal around a primary axis extending through the first and second openings, the first housing member further having a peripheral portion defining a first passage that is distinct from the chamber and configured to receive a pin connector, where:

a first pin connector extends through the first passage and is coupled to the first housing member, where the first passage is configured to surround a majority of a circumference of the first pin connector when the first pin connector extends through the first passage to restrict lateral movement of the first pin connector relative to the first housing member in a direction away from the primary axis and where a first end of the first pin connector extends beyond the mating face of the first housing member; and a first auxiliary line having a first end with a first box connector is coupled to the second housing member;

aligning the first opening, annular seal, and second opening with the first mating face of the first housing member facing the second mating face of the second housing member;

aligning the first box connector of the first auxiliary line with the first end of the pin connector; and moving the second housing member and first housing member together such that the first end of the first pin connector extends into the first box connector.

18. The method of claim 17, further comprising coupling a plurality of auxiliary lines to the second housing member.

19. The method of claim 17, where the second housing member includes a peripheral portion defining a second passage that is distinct from the chamber and configured to receive the first pin connector; and the method further comprises aligning the first pin connector with the second passage and moving the second housing member and first housing member together such that the first end of the first pin connector extends through the second passage.

20. The method of claim 19, where the first housing member includes a first flange portion through which the first passage extends and the second housing member includes a second flange portion through which the second passage extends.

21. The method of claim 17, where the first pin connector comprises a flange having a transverse dimension that is larger than a corresponding transverse dimension of the first passage; and the method further comprises extending the first pin connector through the first passage on the side of the first mating face until the flange contacts the first mating face.

22. The method of claim 17, further comprising coupling the first pin connector to the first housing member with a bracket.

23. The method of claim 17, further comprising:

coupling a first end of a first main tube segment to the first housing member on a side opposite the first mating face, the first main tube segment having a central lumen in fluid communication with the first opening, and coupling a second end of the first main tube segment to a first flange, where the second end of the first main tube segment is spaced apart from the first end of the first main tube segment; and coupling a first end of a second main tube segment to the second housing member on a side opposite the second mating face, the second main tube segment having central lumen in fluid communication with the second opening, and coupling a second end of the second main tube segment to a second flange, where the second end of the second main tube segment is spaced apart from the first end of the second main tube segment.

24. A method of assembling a riser-component comprising:

positioning a first pin connector in a first passage of a first housing member defining a first opening and having a first mating face, the first housing member configured to be coupled to a second housing member defining a second opening and having a second mating face, the second housing member configured to be releasably coupled to the first housing member to define a chamber in fluid communication with the first and second openings, the chamber configured to receive an annular seal around a primary axis extending through the first and second openings, the first housing member further having a peripheral portion defining the first passage such that the first passage is distinct from the chamber and such that, when the first pin connector is positioned in the first passage, the first passage surrounds a majority of a circumference of the first pin connector to restrict lateral movement of the first pin connector relative to the first housing member in a direction away from the primary axis; and coupling the first pin connector to the first housing member such that a first end of the first pin connector extends beyond the first mating face.

* * * * *